US005996286A

United States Patent [19]

West

[11] Patent Number: 5,996,286

[45] Date of Patent: Dec. 7, 1999

[54] MOBILE COLLAPSIBLE SEATING AND PRESENTATION UNIT

[75] Inventor: Daniel C. K. West, Holland, Mich.

[73] Assignee: Haworth, Inc., Holland, Mich.

[21] Appl. No.: 08/945,165

[22] PCT Filed: Jun. 5, 1997

[86] PCT No.: PCT/US97/10570

§ 371 Date: Dec. 31, 1997

§ 102(e) Date: Dec. 31, 1997

[87] PCT Pub. No.: WO97/46778

PCT Pub. Date: Dec. 11, 1997

Related U.S. Application Data

[60] Provisional application No. 60/021,294, Jun. 7, 1996.

[51] Int. Cl.[6] ..... E04H 3/12

[52] U.S. Cl. ..... 52/8; 52/9

[58] Field of Search ..... 52/6–10

[56] References Cited

U.S. PATENT DOCUMENTS 5,325,640 7/1994 Luedke et al. .

5,349,789 9/1994 Andert et al. .

*Primary Examiner*—Beth Aubrey

*Attorney, Agent, or Firm*—Flynn, Thiel, Boutell & Tanis, P.C.

[57] ABSTRACT

A tiered or platform-type seating unit which, when in a collapsed storage position, can be oriented in an upright position and is provided with support rollers which enable it to be moved about, including permitting passage through doorways. When in use, the unit is vertically rotated 90° to position load-bearing rollers thereof in engagement with a floor. The platform unit includes a base platform having a first raised seating tier fixedly associated along one edge thereof. A second seating tier is positioned adjacent the opposite edge thereof. This second tier is movable from a lower position into an upper position so that this second tier is at an elevation above and spaced rearwardly from the first tier, there being an intermediate aisle therebetween. This aisle stores therein, when the unit is collapsed, a pair of removable platforms which are locked between the first and second tiers when the second tier is collapsed. These platforms can also be positioned on the floor in front of the first tier to define a third tier which is disposed at an elevation below the first tier.

19 Claims, 6 Drawing Sheets

MOBILE COLLAPSIBLE SEATING AND PRESENTATION UNIT

This Application Claims Benefit of Provisional Application No. 60/021,294 filed Jun. 7, 1991

FIELD OF THE INVENTION

This invention relates to a mobile, collapsible, and portable seating and presentation unit.

BACKGROUND OF THE INVENTION

Offices and other commercial environments often have a need for a bleacher-type seating platform for multiple individuals for purposes of permitting educational presentations, discussions and the like. Such seating platforms, however, are generally utilized only occasionally, and hence there is a need to be able to readily assemble and collapse the unit so that the room or floor space can be used for other purposes. Further, the seating platform is desirably formed of sufficiently small and portable units as to permit the individual units to be easily stored and yet readily moved through doorways and hallways, with several such units being assembled and positioned adjacent one another to form an overall platform having the desired size and capacity.

It is an object of this invention to provide a mobile, collapsible and relatively portable seating-type tiered platform unit which meets the above objectives.

More specifically, the present invention relates to a tiered-type seating or platform unit which, when in a collapsed storage position, can be oriented upright and is provided with support rollers which enable it to be moved about, including permitting passage through doorways and hallways. When in use, the unit is vertically rotated 90° to position the load-bearing rollers thereof in engagement with a floor. The platform unit includes a base platform having a first raised seating tier fixedly associated along one edge thereof. A second seating tier is positioned adjacent the opposite edge thereof. This second tier is movable from a lower position into an upper position so that this second tier is at an elevation above and spaced rearwardly from the first tier, there being an intermediate aisle or space therebetween. This latter space stores therein, when the unit is collapsed, a pair of removable platforms which are locked between the first and second tiers when the second tier is collapsed. These platforms, when removed, can function as steps for accessing the aisle. These platforms can also be positioned on the floor in front of the first tier so as to define a third tier which is disposed at an elevation below the first tier.

Other objects and purposes of the invention will be apparent to persons familiar with structures of this type upon reading the following specification and inspecting the accompanying drawings.

BRIEF DESCRIPTION OF THE DRAWINGS

FIG. 7 illustrates the platform unit in its collapsed position, and additionally in its upright position so as to permit compact storage thereof, and to also permit mobility thereof such that the unit can be moved through doorways, halls and the like.

Figure 1:
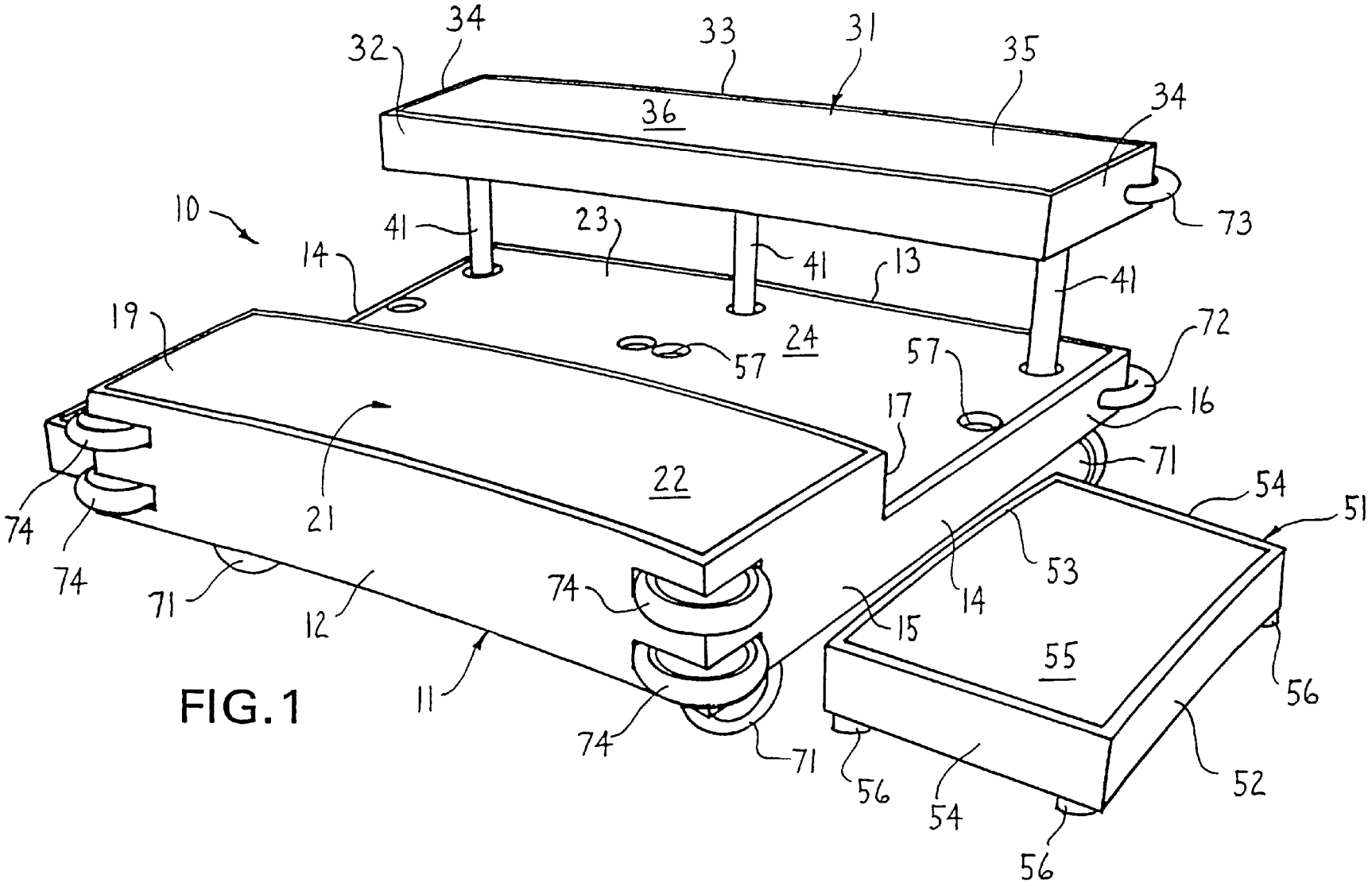
FIG. 1 is a generally front perspective view illustrating the portable platform unit of the present invention in a raised position of use.
Figure 3:
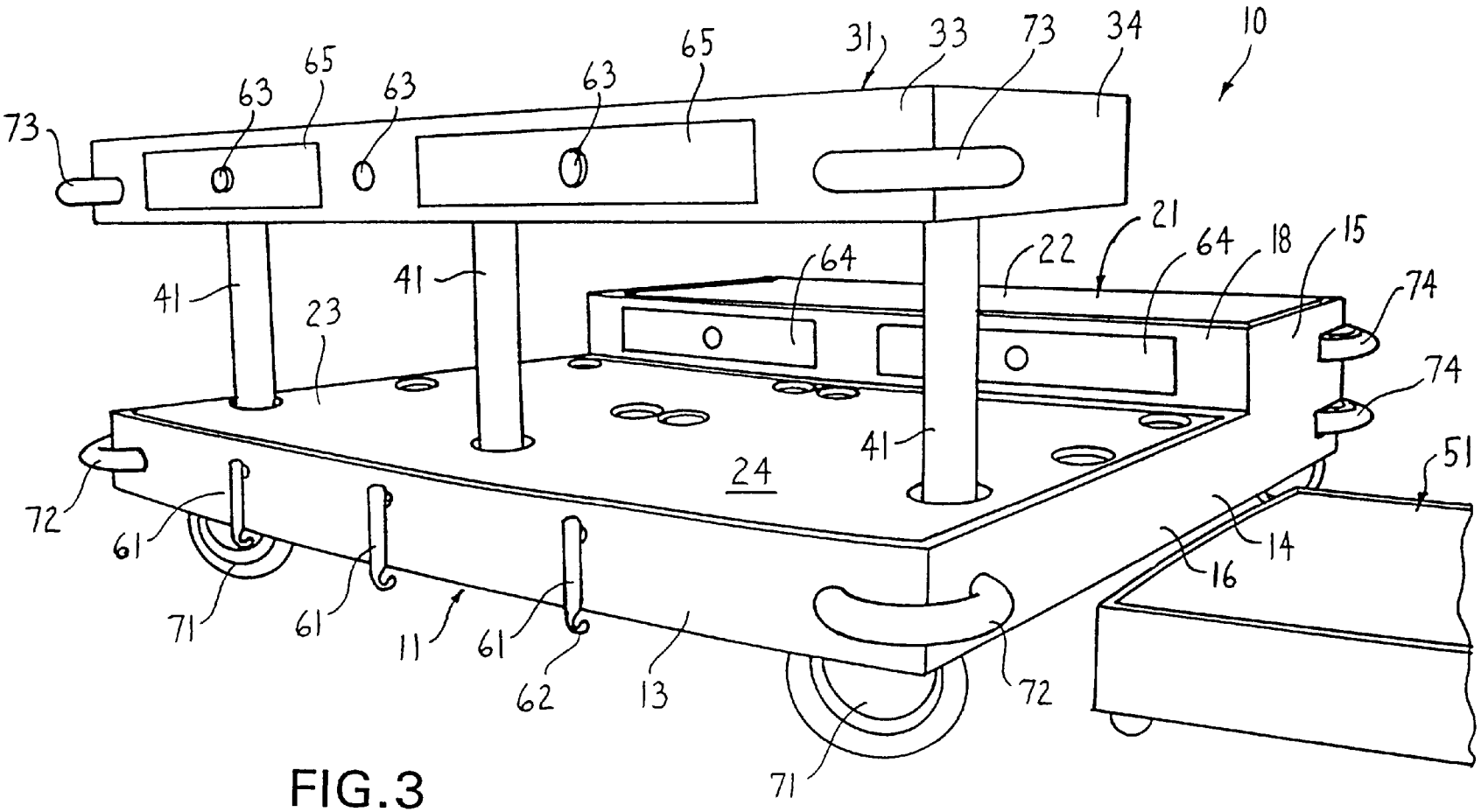
FIG. 3 is a generally rear perspective view of the raised unit illustrated in FIG. 1.
Figure 4:
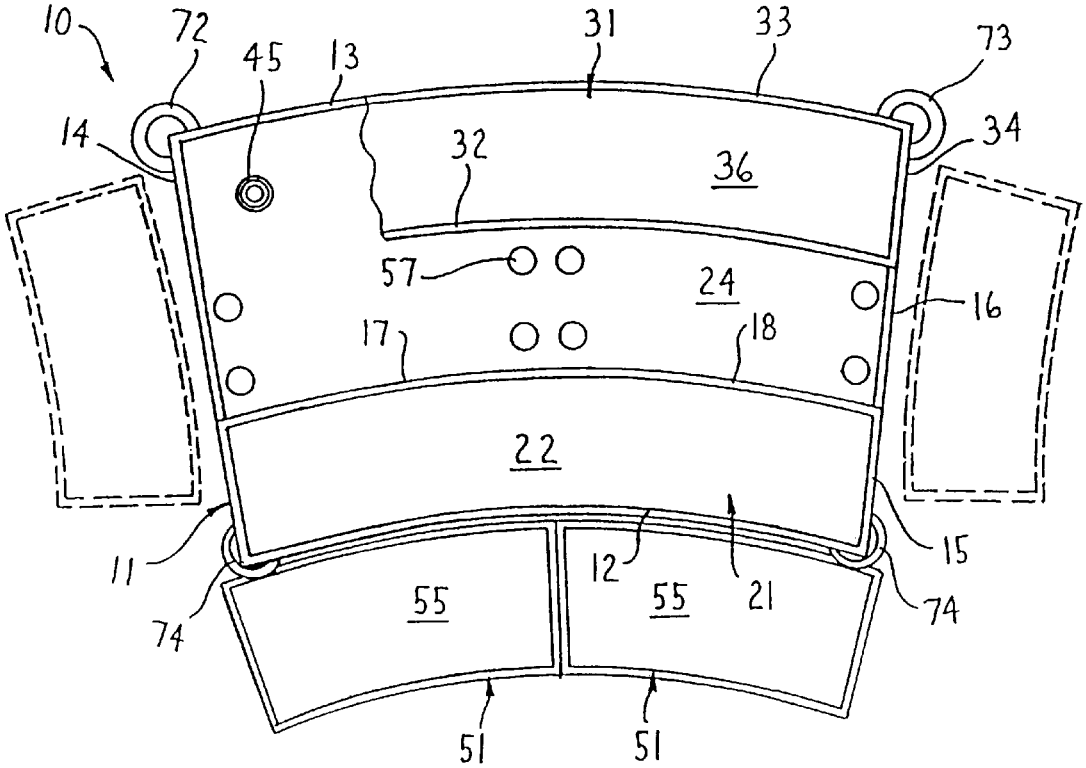
FIG. 4 is a top plan view of the unit generally as shown in FIG. 1.

Certain terminology will be used in the following description for convenience in reference only, and will not be limiting. For example, the words "upwardly", "downwardly", "rightwardly" and "leftwardly" will refer to directions in the drawings to which reference is made. The word "upper" will typically refer to the upper side of the platform unit when it is disposed horizontally for use, such as illustrated by FIGS. 1, 3 and 4. The words "inwardly" and "outwardly" will refer to directions toward and away from, respectively, the geometric center of the unit and designated parts thereof. Said terminology will include the words specifically mentioned, derivatives thereof, and words of similar import.

DETAILED DESCRIPTION

Referring to the drawings, the present invention relates to a portable tiered seating or platform unit 10. The unit 10 is illustrated in its expanded use position in FIGS. 1–4, is illustrated in its collapsed use position in FIG. 5, and is illustrated in its collapsed but upright storage position in FIG. 7, this latter upright storage position being one wherein the unit is rotated upwardly 90° from the use position illustrated by the other drawings.

The platform unit 10, as shown in FIGS. 1–4, includes a base platform 11 of generally rigid construction and having a generally rigid rectangular frame defined by generally parallel front and rear walls or rails 12 and 13, respectively, the latter being rigidly joined together by a pair of generally parallel side rails 14. The side rails 14 are each of a generally vertically stepped configuration in that they include a front part 15 which is approximately twice the height of the rear part 16, these two parts defining a rearwardly facing step 17 at the rearward edge of the front part 15. The front part 15 extends rearwardly from the front edge of the base platform through a distance which is about one-third of the overall front-to-back length, and the lower rear part 16 projects throughout the remaining width of the base platform. An intermediate rear wall or rail 18 extends horizontally between the rear edges of the front side rail parts 15 and defines the rear step 17.

The base platform 11 includes a first top wall 19 which is fixed to and extends generally horizontally between the raised side rail parts 15 and the front and intermediate rear rails 12 and 18. This top wall 19 cooperates with the raised front rail parts 15 as well as the longitudinal rails 12 and 18 to define a first or front seating tier 21 which is elongated along the front edge of the platform unit. This front tier defines a generally horizontally enlarged, planar and upwardly facing support or seating surface 22, the latter being defined primarily by the top wall 19, although this top wall will typically be suitably covered with carpeting or the like, or provided with removable cushions, so as to function as a seating surface for three or more people.

The base platform 11 has a second horizontally enlarged top wall 23 which projects longitudinally between the lower rear side rail parts 16, and which also projects widthwise between the rear rails 13 and 18. This top wall 23, which is typically provided with carpeting or the like adhered thereto, defines a horizontally enlarged and substantially planar upwardly facing top surface 24 which functions essentially as a floor for a rear raised seating platform or tier 31, as described below. The floor or surface 24 is disposed substantially flush with upper edges of the lower rear side rail parts 16, and hence is at an elevation substantially below the elevation of the seating surface 22 defined by the front seating tier 21.

Figure 2:
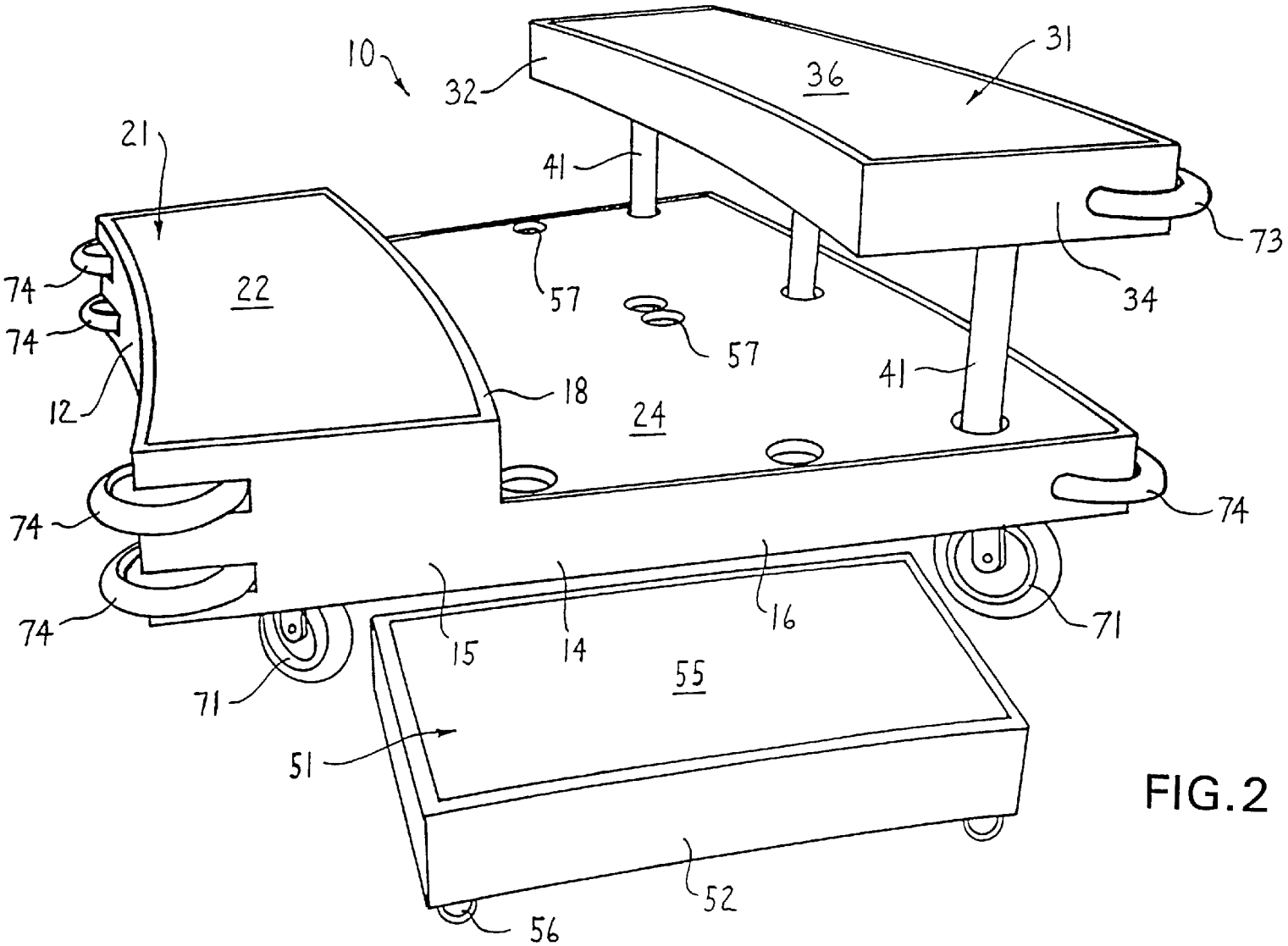
FIG. 2 is a generally side perspective view of the raised unit illustrated in FIG. 1.
Figure 5:
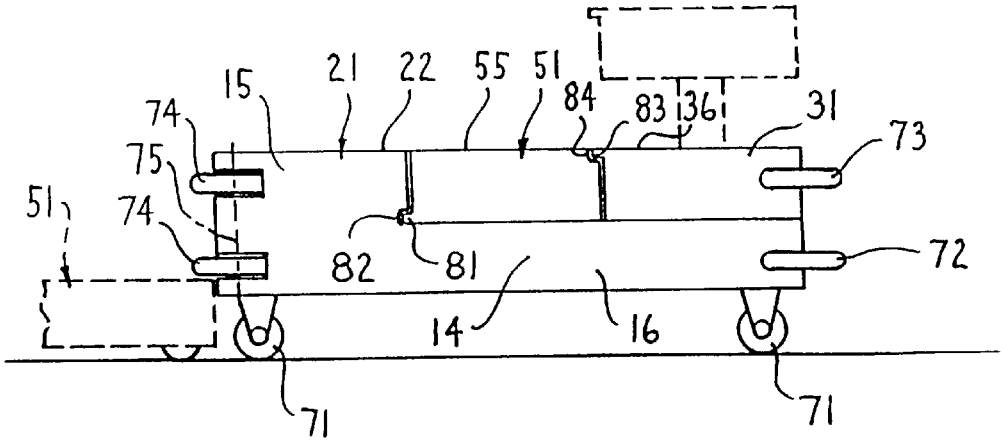
FIG. 5 is a side elevational view showing the platform unit in the collapsed position, and illustrating the manner in which the removable third tier platforms are held between the first and second tier platforms.

The rear seating platform or tier 31 is disposed adjacent and extends longitudinally along the rear edge of the base platform, and is vertically movable between a raised use position illustrated by FIGS. 1–3, and a lowered storage position illustrated in FIG. 5. This rear seating platform or tier 31 also includes a generally rectangular frame defined by generally parallel and longitudinally extending front and rear rails 32 and 33, respectively, which are rigidly joined together by generally parallel side rails 34. This frame also has a generally enlarged top wall 35 fixed thereto, whereby the rear platform 31 defines a generally horizontally enlarged and planar upper support or seating surface 36. This surface 36 is typically provided with carpeting secured to the top wall 35, but can be provided with removable cushions if desired.

The rear platform or tier 31 is connected to the base platform 11 by a plurality of extendible and contractible supports 41 to permit raising and lowering of the rear seating tier. The extendible and contractible supports 41, of which there are three in the illustrated embodiment, can be of many different constructions or configurations, and reference is made to FIG. 6 wherein one type of support 41 is illustrated.

Figure 6:
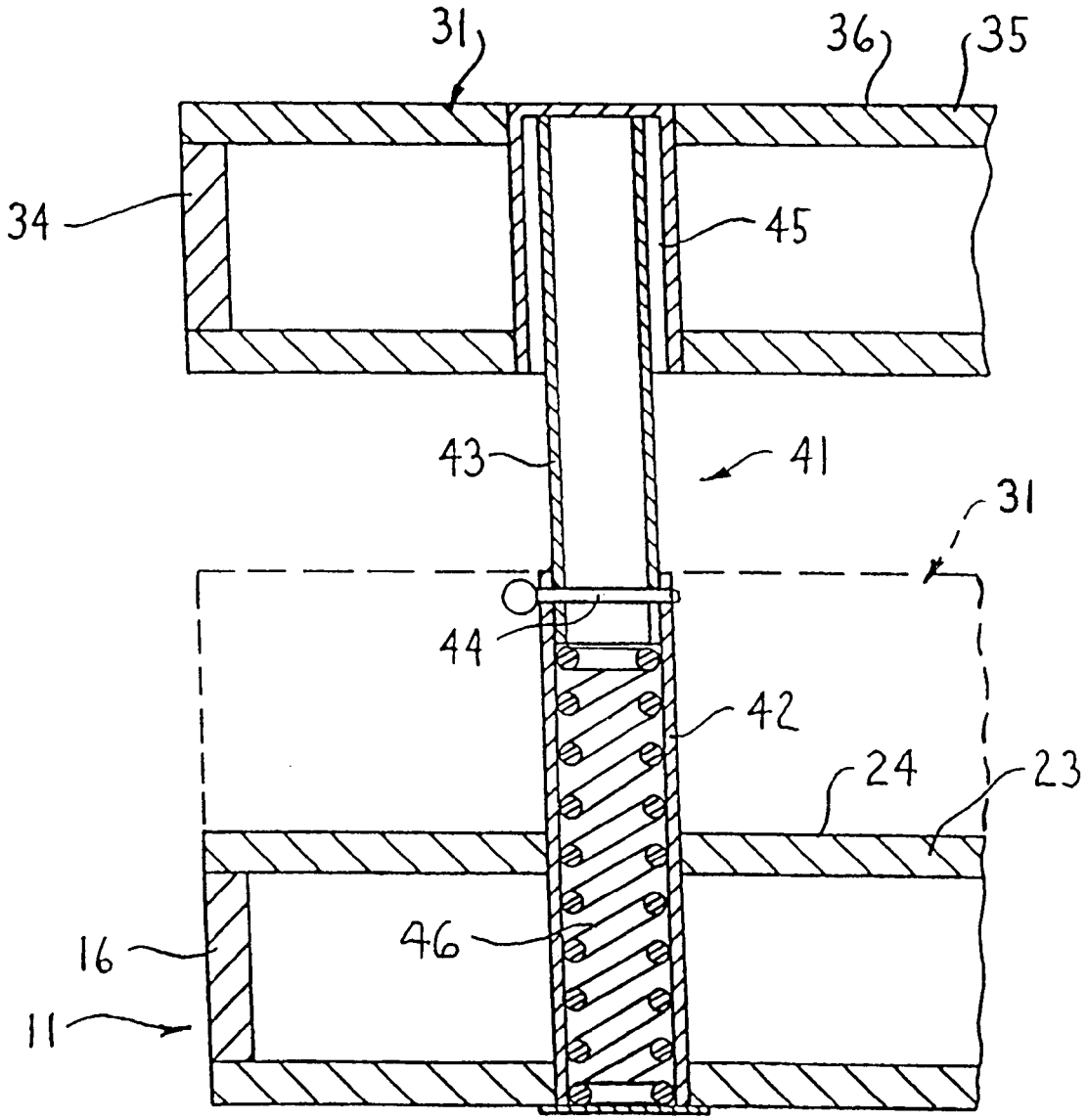
FIG. 6 is a fragmentary sectional view illustrating the extendible supports which connect the raisable second tier platform to the base platform.

As shown by FIG. 6, the support 41 includes an upright cylindrical tube 42 which is fixed to the base platform 11 and which projects vertically upwardly a significant distance above the upper surface or floor 24. This base tube 42 in turn slidably telescopically receives therein a vertically elongate cylindrical support tube 43 which is fixed to the rear tier 31 and which projects downwardly therefrom for slidable projection into the interior of the upright tube 42. The platform or tier 31 also has an annular recess or socket 45 defined therein in surrounding relationship to the tube 43 so as to slidably accommodate therein the upper projecting portion of the lower tube 42 when the rear tier 31 is lowered into a collapsed position wherein it rests on the floor 24, substantially as illustrated by dotted lines in FIG. 6. To maintain the rear tier 31 in a raised position, suitable fasteners can be provided. For example, FIG. 6 illustrates a pin 44 inserted through aligned openings formed adjacent the ends of the cylindrical tubes 42 and 43. This pin 44 will be inserted when the third tier is extended, and removed when it is to be collapsed. The pin can be provided with a detent ball adjacent the free end thereof, and with a pull ring at the other end to facilitate handling thereof. Other suitable locking devices can also be provided.

If necessary or desired, an elongate compression spring 46 can be disposed to extend interiorly lengthwise along the telescopic tubes 42 and 43, which spring can be used to normally urge or bias the tier 31 toward the raised position. If such spring 46 is used, then a stop will preferably be provided for cooperation between the telescopic tubes 42 and 43 to prevent inadvertent separation thereof.

When the rear tier 31 is in the collapsed position illustrated in FIG. 5 and as shown by dotted lines in FIG. 6, the upper surface 36 thereof will be substantially horizontally coplanar with the upper surface 22 of the front tier 21. When the rear tier 31 is in the raised position, however, the upper surface 36 is disposed upwardly a substantial distance above the seating surface 22 of the front tier 21.

The rear tier 31, like the front tier 21, has a width in the front-to-back direction which will normally extend only approximately one-third of the overall front-to-back dimension of the base platform 11. This thus results in the defining of a fairly wide aisle or knee space between the respective front and rear tiers 21 and 31 so that several people can be seated on the rear tier 31 with their legs positioned comfortably in the aisle defined between the tiers, with the height of the rear tier 31 being such that the feet of the occupants can comfortably rest on the floor 24.

The portable platform unit 10 of this invention also incorporates a pair of generally identical removable boxlike platforms 51 which effectively cooperate to define a third tier or platform which can be positioned adjacent the front rail 12. The pair of boxlike platforms 51, when the unit 10 is in a collapsed or storage position, are stored within the channel-like space defined between the first tier 21 and the collapsed second tier 31, as illustrated by FIG. 5. Each platform 51 has a generally boxlike rectangular frame defined by generally parallel front and rear rails 52 and 53, respectively, which are rigidly joined by generally parallel side rails 54. These rails in turn are rigidly joined by a generally horizontally extending top wall 55 which defines thereon an upwardly facing support surface which can function as a seating surface, and for this reason the top wall is normally provided with carpeting affixed thereto and extending thereover or, alternatively, suitable removable cushions can be provided for disposition over the top wall 55 if desired.

The removable platform 51 has a plurality, here four, of legs 56 which are affixed thereto in the vicinity of the corners thereof. These legs project downwardly for supportive engagement with a floor when the platform 51 is removed from the unit 10. When disposed and stored on the unit 10, however, the legs 56 project into sockets 57 which are formed in the floor 24.

To facilitate securement of the platform 51 to the unit 10 when the latter is in a collapsed position, the platform 51 as illustrated in FIG. 5 can be provided with a rib or ledge 81 which projects forwardly from the front rail 52 thereof for insertion into an undercut groove 82 formed in the rear rail 18. Similarly, the second or rear tier 31 can be provided at its upper surface with a forwardly projecting lip or flange 83 which, when the tier 31 is collapsed, seats within a corner cutout 84 formed along the rear upper edge of the platform 51. The cooperations defined by the ribs 81–82 and 83–84, as well as the cooperation of the legs 56 within the sockets 57, prevents the platform 51 from being removed from the unit 10 when the latter is in the collapsed position of FIG. 5 or in the collapsed storage position of FIG. 7. It should be noted that the sockets 57 are preferably somewhat oversized or elongated in the front-to-back direction of the base platform so as to enable the platforms 51 to be seated in the sockets and then slid forwardly a small amount to permit insertion of the flange or tongue 81 into the undercut groove 82. It will also be appreciated, however, that numerous other structures could be provided for defining a locking function for the platforms 51.

The rear rail 13 of the base platform 11 is also preferably provided with plurality of latches 61 (FIG. 3) mounted thereon, such as by swivels or pivots, and these latches in turn have hooks 62 which are adapted to engage loops or knobs 63 provided on the rear rail 33 of the rear tier 31.

When the rear tier 31 is in the collapsed position, the latches 61 can be moved upwardly so that the hooks 62 thereof engage the loops or knobs 63 to securely retain the rear tier 31 in the collapsed position.

Each of the tiers 21 and 31 can also be provided with storage drawers therein if desired. For example, as illustrated by FIG. 3, the tier 21 is illustrated as having a pair of slidable drawers 64 associated therewith, which drawers are provided in the rear rail 18 and can be slidably opened rearwardly to access the drawer. Similar such drawers 65 are associated with the rear rail 33 of the rear tier 31, and these drawers are slidably pulled rearwardly so as to open same. The construction of such drawers is conventional.

To provide load-bearing but movable support for the platform unit 10 when in the use position, the base platform 11 is provided with a plurality, here four, of rollers 71 which are mounted on and project downwardly from the lower surface of the base platform. These rollers 71, which are preferably swivel-type caster units, to enable the unit 10, when in the use position (whether collapsed or extended), to be rolled about so as to be disposed in the desired location. This also facilitates the positioning of several such units 10 in adjacent and generally aligned abutting relationship. The rollers 71 can be provided with conventional wheel brakes to permit locking of the rollers when the unit 10 is in the desired location.

Both rear corners of the base platform 11 are provided with loop-like handles 72 affixed thereto, and similar loop-like handles 73 are fixed to each rear corner of the rear tier 31. These handles facilitate the portability and movement of the device, particularly the tilting movement of the unit between the horizontally-oriented use position illustrated by FIGS. 1–5, and the upright storage position of FIG. 7.

The front corners of the base platform 11 are also each provided with a pair of coaxially aligned rollers 74 which project outwardly beyond the corner of the frame. The rollers 74 are supported for rotation about axes 75 which extend generally perpendicularly with respect to the seating surface 22 of the tier 21. These rollers 74 are provided so that, when the collapsed unit 10 is tilted into the upright storage position illustrated by FIG. 7, the rollers 74 are thus disposed for rolling engagement with the floor. This enables the unit to be readily rolled about, and the upright relationship of the unit 10 enables the unit to be moved through rather narrow doorways and halls. This upright orientation of the unit 10, when in the collapsed storage position illustrated by FIG. 7, also enables one or more such units 10 to be more conveniently stored since the unit occupies minimal floor space, and several such units can be conveniently and compactly stored in a relatively small storage area.

The operation of the platform unit 10 will now be briefly summarized.

Figure 7:
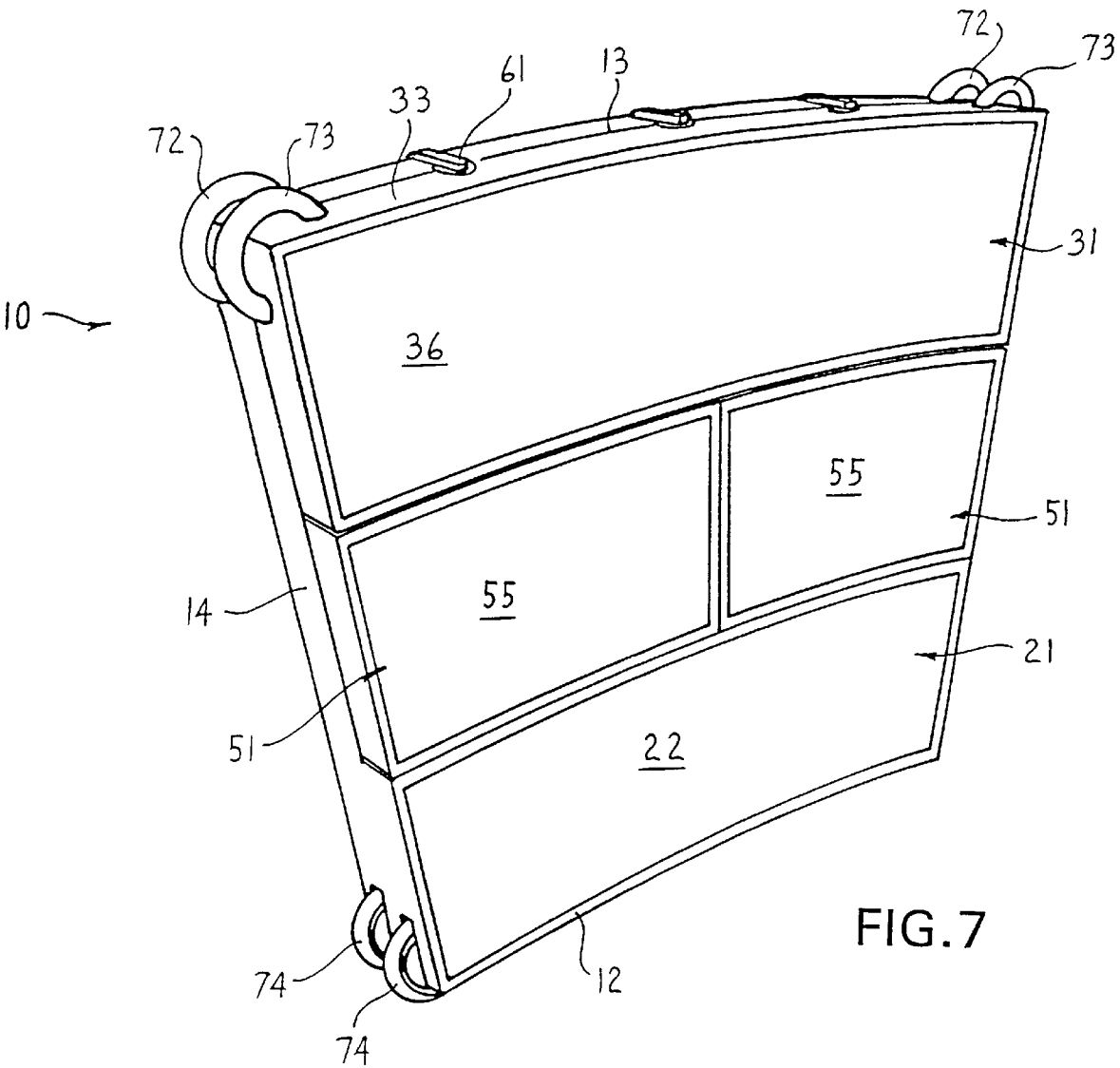

The unit will normally be maintained in a collapsed position, and stored in a generally upright orientation substantially as illustrated by FIG. 7. In this collapsed upright storage condition, the platform unit 10 has a height less than typical doorway heights so as to be passable therethrough, and also has a width which is also less than typical doorway widths. The unit is supported by the pairs of rollers 74 disposed adjacent the opposite ends of the unit, and the unit particularly with assistance of the handles 72 and 73 can be readily rolled along a flat surface and manually manipulated as desired.

When use of the unit 10 is desired, it is moved generally to the desired location, and then the unit, normally with the assistance of two operators, is vertically pivoted sidewardly from the upright orientation of FIG. 7 so that the main support rollers 71 are disposed in engagement with the floor. The latches 61 are then released and the rear tier or platform 31 is raised upwardly into its extended position, such raising being manually or with spring assist if springs are provided. The support columns 41 are then locked in the extended position substantially as illustrated in FIG. 6.

The portable platforms 51 are then manually removed so as to define the aisle or space between the tiers 21 and 31.

One or both of the portable platforms 51 can initially be used as steps, and for such purpose they can be positioned adjacent opposite sides of the base platform generally in line with the aisle between the front and rear tiers, as illustrated in FIG. 1, so as to provide a convenient intermediate step to facilitate access into the aisle in front of the raised rear tier 31. This latter disposition of the removable platform 51 is indicated by dotted lines in FIG. 4.

Alternatively, the pair of portable platforms 51 can be positioned generally in end-to-end relationship in front of the base platform 11. When the portable platforms 71 are so positioned, which position is illustrated by solid lines in FIG. 4, they are disposed in front of the front rail 12 but, since the upper seating surfaces 55 on the platforms 51 are disposed at an elevation substantially below the elevation of the seating surface 22 of the first tier 21, these portable platforms 51 hence in effect define a third tier which is positioned at a lower elevation in front of the first tier 21, the latter hence defining an intermediate elevation between the rear tier 31 and a front tier defined by the platforms 51.

It is contemplated that in most situations a plurality of units 10 will be positioned generally in side-by-side relation so as to provide an overall bleacher-type seating platform of greater seating capacity. When so positioned, the side rails 14 of adjacent tiers will be positioned closely adjacent one another, and can be suitably interlocked together by conventional releasable clamps or the like, if desired. In such instance, however, appropriate bridging plates will also typically be provided on the floors 24 of adjacent units so as to define a substantially continuous aisle extending along the side-by-side and interconnected units.

If desired, the front and rear rails defining the base platform and the tiers can be of a horizontally shallow arcuate curvature generated about a center point which theoretically is positioned closely adjacent a focal point of the presentation, such as a speaker's stand or the like, whereby when a plurality of such units are coupled together, they will define an arcuate configuration so as to provide for a more uniform encircling and positioning of the platform units around the presentation focal point. The drawings as described above illustrate the front and rear rails having such curvature, but it will be appreciated that the rails can also be straight if desired. If the front and rear rails are constructed straight, rather than curved, and if it is still desired to provide an arcuate configuration if several such units are joined together, then in such case the side rails 14 of the individual base platforms can themselves be of a slightly diverging configuration as they project rearwardly, since such would enable several units 10 to be positioned in side-by-side relationship and still effectively provide an overall arcuate configuration in plan view.

Although a particular preferred embodiment of the invention has been disclosed in detail for illustrative purposes, it will be recognized that variations or modifications of the disclosed apparatus, including the rearrangement of parts, lie within the scope of the present invention.

I claim:

1. A mobile and collapsible seating platform unit, comprising:

a base platform having a horizontally enlarged and generally rectangular configuration defining elongate front and rear edges, said base platform having a first seating tier fixed thereto and extending along said front edge, said first seating tier being elongated along said front edge and defining a first generally horizontally enlarged seating surface defined at a first elevation, said first tier extending away from said front edge rearwardly toward said rear edge partially of the overall distance which extends transversely between said front and rear edges of said base platform and ending in an intermediate rear edge;

a second seating tier positioned adjacent and extending generally along said rear edge of said base platform, said second seating tier projecting forwardly away from said rear edge generally toward said front edge partially of the overall transverse distance between said front and rear edges, said second seating tier having a front edge which is spaced rearwardly a substantial distance from said intermediate rear edge of said first seating tier so as to define an upwardly open aisle therebetween;

extendible and contractible support means connected to said base platform and said second seating tier for permitting vertical movement of said second tier between an extended use position and a collapsed storage position, said second tier defining thereon a horizontally enlarged second seating surface which is at a second elevation which is substantially above said first elevation when said second tier is in the extended position, said second seating surface being substantially at said first elevation when said second tier is in the storage position;

a portable platform removably positioned within the aisle defined between said first and second tiers when said second tier is in said collapsed position, said portable platform defining thereon an upper generally horizontally enlarged surface which is substantially at said first elevation when said platform is stored within said aisle;

a first plurality of rollers mounted on and projecting downwardly from said base platform for supportive and rolling engagement with a floor, said rollers being rotatable about individual axes which extend generally parallel with said seating surfaces; and a second roller rotatably mounted on said base platform adjacent each front corner thereof, said second rollers being rotatable about axes which extend substantially perpendicularly with respect to said first seating surface, said second rollers being positioned for rolling engagement with a floor when the collapsed seating unit is pivoted vertically upwardly from a use position of the seating unit into a generally upright position.

2. A unit according to claim 1, wherein said portable platform, when removed from said aisle, can be positioned adjacent and project forwardly from the front edge of said base platform to define a third seating tier, said upper surface of said portable platform being disposed at a third elevation which is spaced vertically downwardly a substantial distance from said first elevation.

3. A seating platform unit according to claim 1, wherein said portable platform has a plurality of legs projecting downwardly for supportive engagement with the floor when said portable platform is removed from said aisle.

4. A seating platform unit according to claim 3, wherein said aisle has a plurality of downwardly opening sockets disposed thereon, said legs being engageable within said sockets when said portable platform is stored in said aisle such that said portable platform upper enlarged surface is substantially at said first elevation.

5. A seating platform unit according to claim 1, wherein said portable platform has a rib for engagement with a groove in said first tier and a corner cutout for engagement with a flange in said second tier such that said rib and groove and said flange and cutout secure said portable platform to said base platform when said second tier is in said collapsed position.

6. A seating platform unit according to claim 1, wherein a locking means is provided between said base platform and said second seating tier to secure said second tier in said collapsed position.

7. A seating platform unit according to claim 1, wherein said first and second tiers each have a plurality of slidable storage drawers provided therein.

8. A seating platform unit according to claim 1, wherein said support means includes a pair of telescoping vertically elongated cylindrical tubes disposed within one another and fastener means for fixing said tubes in said extended use position.

9. A seating platform unit according to claim 8, wherein said support means includes a spring disposed within said telescoping tubes for biasing said second tier toward said extended use position.

10. A seating platform unit according to claim 1, wherein at least one bridging plate is used to interconnect two or more of said platform units together.

11. A mobile and collapsible seating platform unit, comprising:

a base platform having a horizontally enlarged and generally rectangular configuration defining elongate front and rear edges, said base platform having a first seating tier fixed thereto and extending along said front edge, said first seating tier being elongated along said front edge and defining a first generally horizontally enlarged seating surface defined at a first elevation, said first tier extending away from said front edge rearwardly toward said rear edge partially of the overall distance which extends transversely between said front and rear edges;

a second seating tier positioned adjacent and extending generally along said rear edge of said base platform, said second seating tier projecting forwardly away from said rear edge generally toward said front edge and extending through a distance partially of the overall transverse distance between said front and rear edges, said second seating tier having a front edge which is spaced rearwardly a substantial distance from a rearward edge of said first seating tier so as to define an upwardly opening aisle therebetween;

extendible and contractible support means connected to said base platform and said second seating tier for permitting vertical movement of said second tier between an extended use position and a collapsed storage position, said second tier defining thereon a horizontally enlarged second seating surface which is at a second elevation which is substantially above said first elevation when said second tier is in the extended position, said second seating surface being substantially at said first elevation when said second tier is in the storage position;

a plurality of first rollers mounted on and projecting downwardly from said base platform for supportive and rolling engagement with a floor, said first rollers being rotatable about individual axes which extend generally parallel with said seating surfaces; and a plurality of second rollers rotatably mounted on said base platform adjacent opposite ends of one of said front and rear edges, said second rollers being rotatable about axes which extend substantially perpendicularly with respect to said first seating surface, said second rollers being positioned for rolling engagement with a floor when the collapsed seating unit is pivoted vertically upwardly from a use position of the seating unit into a generally upright position.

12. A seating platform unit according to claim 11, wherein a locking means is provided between said base platform and said second seating tier to secure said second tier in said collapsed position.

13. A seating platform unit according to claim 11, wherein said first and second tiers each have a plurality of slidable storage drawers provided therein.

14. A seating platform unit according to claim 11, wherein said support means includes a pair of telescoping vertically elongated cylindrical tubes disposed within one another and fastener means for fixing said tubes in said extended use position.

15. A seating platform unit according to claim 14, wherein said support means includes a spring disposed within said telescoping tubes for biasing said second tier toward said extended use position.

16. A unit according to claim 1, wherein said first tier, second tier and portable platform each include a front to rear distance which is about one-third of said overall distance from said front and rear edges of said base platform.

17. A unit according to claim 1, wherein said front and rear edges of said base platform have a shallow arcuate curvature.

18. A unit according to claim 11, wherein said first tier, second tier and portable platform each include a front to rear distance which is about one-third of said overall distance from said front and rear edges of said base platform.

19. A unit according to claim 11, wherein said front and rear edges of said base platform have a shallow arcuate curvature.

* * * * *